US007951058B2

(12) United States Patent
Pettersson

(10) Patent No.: US 7,951,058 B2
(45) Date of Patent: May 31, 2011

(54) APPARATUS AND METHOD FOR THE MANUAL FOLDING OF A PACKING BLANK

(75) Inventor: Niklas Pettersson, Enköping (SE)

(73) Assignee: Packsize LLC, Salt Lake City, UT (US)

( * ) Notice: Subject to any disclaimer, the term of this patent is extended or adjusted under 35 U.S.C. 154(b) by 893 days.

(21) Appl. No.: 11/909,490

(22) PCT Filed: Mar. 23, 2006

(86) PCT No.: PCT/SE2006/000361
§ 371 (c)(1),
(2), (4) Date: Sep. 24, 2007

(87) PCT Pub. No.: WO2006/101443
PCT Pub. Date: Sep. 28, 2006

(65) Prior Publication Data

US 2010/0193580 A1 Aug. 5, 2010

(30) Foreign Application Priority Data

Mar. 24, 2005 (SE) ..... 0500676

(51) Int. Cl.
*B31B 13/00* (2006.01)

(52) U.S. Cl. ..... 493/356; 493/397; 493/405

(58) Field of Classification Search ..... 493/356, 493/397, 399, 405, 480, 901
See application file for complete search history.

(56) References Cited

U.S. PATENT DOCUMENTS

| | | | | | |
|---|---|---|---|---|---|
| 1,153,951 | A | * | 9/1915 | Plante | 493/396 |
| 1,221,213 | A | * | 4/1917 | Plante | 493/396 |
| 2,056,093 | A | * | 9/1936 | Claff | 493/59 |
| 2,128,982 | A | | 6/1938 | Bickford | |
| 2,829,569 | A | | 8/1958 | Aquilla | |
| 3,160,344 | A | | 12/1964 | Bogren | |
| 4,584,818 | A | * | 4/1986 | Plaskett | 53/377.5 |
| 4,656,810 | A | * | 4/1987 | Plaskett | 53/377.5 |
| 4,822,325 | A | * | 4/1989 | Vossen | 493/1 |
| 5,102,382 | A | * | 4/1992 | Center et al. | 493/1 |
| 5,334,068 | A | * | 8/1994 | Davis | 446/34 |
| 5,855,543 | A | * | 1/1999 | Carbone | 493/59 |
| 2002/0036230 | A1 | | 3/2002 | Chevalier et al. | |

FOREIGN PATENT DOCUMENTS

| | | |
|---|---|---|
| DE | 8020235 | 10/1980 |
| GB | 366051 | 4/1930 |

* cited by examiner

*Primary Examiner* — Sameh H. Tawfik
(74) *Attorney, Agent, or Firm* — Young & Thompson

(57) ABSTRACT

A tool for the manual folding of a package blank into a package, includes a bottom plate (2) with an abutment (3) erect from the front edge of the bottom plate, a tongue (4) protruding in front of the abutment from the front edge of the bottom plate, and a jaw (6) acting against the tongue from above, as well as a lip (8) protruding from the abutment, which is spring loaded and back-springing and which is retractable into the abutment against the spring force in dependence of the fact that a part of a package blank in one fold operation is made to pass by the lip, and which thereafter springs back to support the package blank in the attained folded position. A package blank, a method for preparing a package and the use of a tool for preparing a package by folding a package blank are also disclosed.

15 Claims, 3 Drawing Sheets

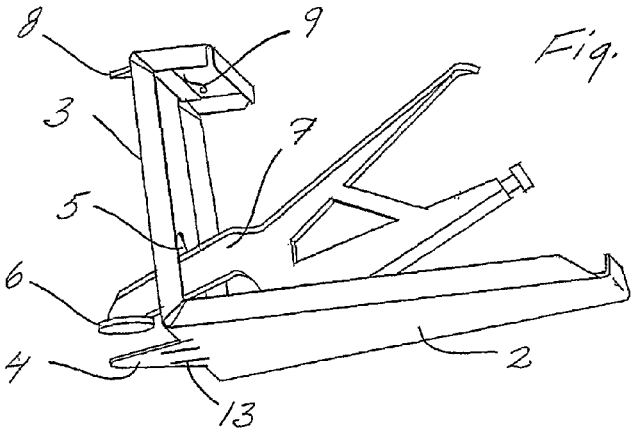
Fig. 4
Fig. 1
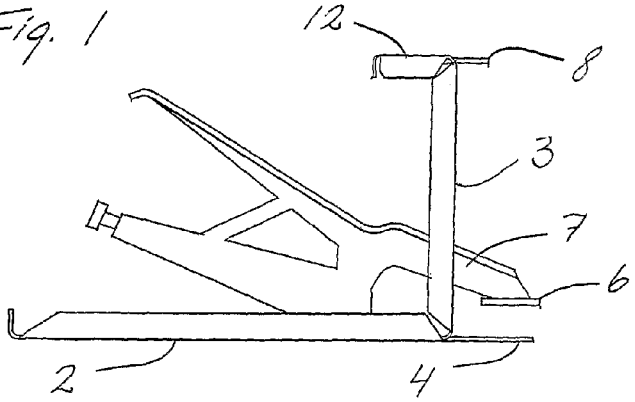
Fig. 3
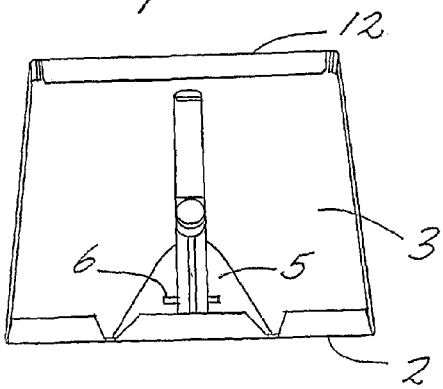
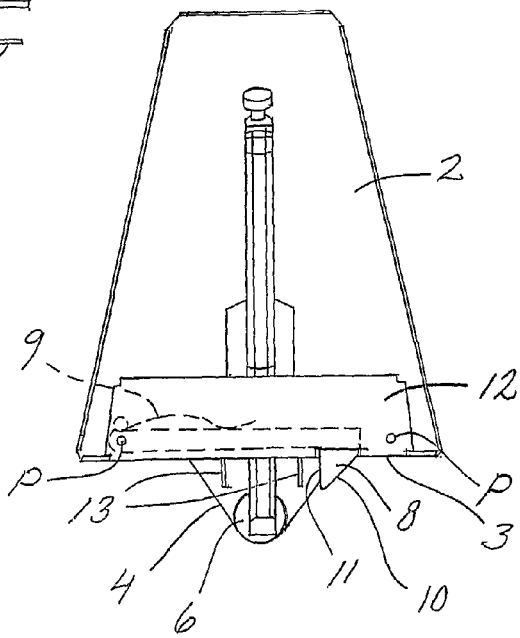
Fig. 2

S
B
U
C
L
A
I
A
A
S
I
T
A
S
B
C

U
V
X
X
A
A
B
T
C
V

R

APPARATUS AND METHOD FOR THE MANUAL FOLDING OF A PACKING BLANK

BACKGROUND OF THE INVENTION

The invention concerns a tool formed as an auxiliary tool for the manual folding of a package blank in order to prepare a box shaped package. Accordingly, the invention also provides a package blank, a method for the preparation of a package and the use of a tool in order to prepare a package by folding a package blank.

DESCRIPTION OF THE RELATED ART

In the manual folding of package blanks, especially in order to prepare box shaped packages designed with a reinforced protective zone in the ends and bottom and/or top of the package, respectively, an additional number of folds are performed along fold lines in order to prepare a raised or lowered area inside of a rim extending around the perimeter of the package and comprising doubled material. During the folding operation there is a need to temporarily fix the package blank in an attained folded position.

A tool for this purpose must allow simple holding and simple unfastening of the package blank. The invention aims at fulfilling this requirement, and, in additional aspect, also a requirement for facilitated insertion of products during the completion of the package.

BRIEF SUMMARY OF THE INVENTION

Briefly, the tool according to the invention is characterized by means that can be activated to temporarily clamp the package blank against a work surface, and means that can be activated to support part of the package blank in a position erected from the work surface.

In the shown implementation, the tool is designed with a bottom plate having a support wall or abutment erect from the front edge of the bottom plate, a tongue protruding in front of the support wall from the front edge of the bottom plate, and a jaw acting from above against the tongue, as well as a spring loaded and back-springing lip protruding in front of the support wall and retractable against the spring force in dependence of the fact that during folding a part of a package blank is made to pass by the lip, and then springs back to support the package blank in the attained folded position.

The characterizing features of the package blank provided by the invention, the method, and the inventive use of the tool will become apparent from the below.

BRIEF DESCRIPTION OF THE DRAWINGS

The invention will be described in more detail below with reference to the enclosed drawings, wherein FIG. 1 shows the tool in a lateral elevation view;

FIG. 2 shows the tool in a top elevation view;

FIG. 3 shows the tool in a rear elevation view;

FIG. 4 shows the tool in an oblique bottom/rear perspective view;

DESCRIPTION OF THE PREFERRED EMBODIMENTS

Figures 6A, 6B, 6C, 6D:
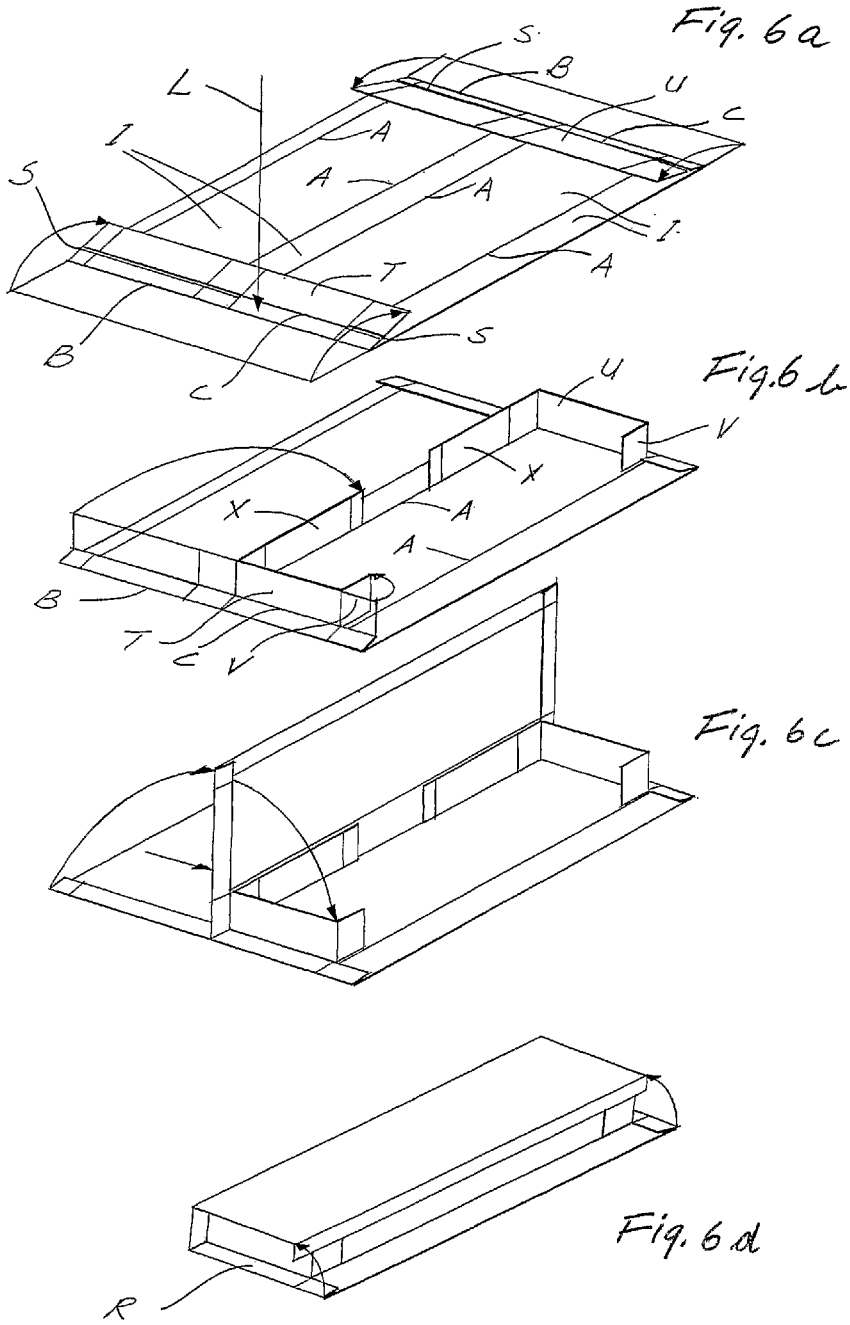
FIGS. 6*a*-6*d* show different operations for folding the package blank in order to prepare a package having a reinforced end zone, utilizing the tool according to the invention.

Referring to FIG. 6*a*, a package blank is shown wherein slits and fold lines have been introduced in a planar initial format for folding the blank into a box shaped package. Thus, the package blank comprises three or more parallel fold lines A defining the lateral walls I of the package and forming the corner edges of the completed package when the package blank has been folded into a box shaped package. In at least one, and preferably both ends of the package blank, two parallel fold lines B and C extend perpendicularly to said first lines. Of these latter fold lines, the inner fold line B forms the end edges of the completed package. The outer fold line C, extending over a single lateral wall and outside of said wall passing into slits S, forms the connection of the end wall T, U to the peripheral rim R of doubled material formed by folding the blank along the fold line B. In this manner, a package having a protective zone in its ends is formed, whereby the end walls obtains a retracted position between extended lateral walls with a shock absorbing end zone made from doubled material. In order to fully understand the design of the completed package, reference is made to the series of pictures in FIGS. 6*a*-6*d*.

Referring to FIGS. 1-4, a tool according to the invention is shown, designed as an auxiliary tool for manually folding a package blank, and typically a package blank of the type described above.

The tool 1 comprises a bottom plate 2, having on one of its, henceforth considered front edges an erect abutment 3, in the embodiment shown formed as a support wall 3 extending substantially vertically erect. From the front edge of the bottom plate 2 a tongue 4 projects in front of the support wall/abutment 3. Through an opening 5, formed in the abutment or support wall 3 and in the embodiment shown delimited by the front edge of the bottom plate, a jaw 6 extends through the support wall and out above the tongue. The jaw 6 is movably arranged and can be activated for temporary clamping of the protective zone of the package blank in the gap between the tongue 4 and the jaw. For this purpose, the jaw is suitably supported in the tip of a leg 7 mounted on the bottom plate and extending through the opening 5. The jaw 6 and the leg 7 may advantageously form parts of a pair of grab tongs or a welding gun mounted on the bottom plate, e.g. by welding or bolts. Preferably, the leg is provided with a release mechanism for single handed activation of a kind known per se from commercially available grab tongs, such as the grab tongs manufactured by Danish company Scangrip A/S.

A lip 8 is arranged in the support wall 3 and movable between a position protruding in front of the support wall and a position retracted inside of or into the support wall. The lip is biased to the protruding position by a spring means 9 and retractable against the action of the spring means as a function of the fact that a part of the package blank during a fold operation is made to pass the lip. The protruding part of the lip 8 is delimited on one side by an edge 10 that is tilted in relation to the support wall 3 and, in the tip of the lip, transforms into an edge 11 that is substantially perpendicular to the support wall and forms the other side of the lip 8. Since part of the package blank is erected from the support in one fold operation, by folding along a fold line A, and is made to pass substantially parallel to the support wall in the direction of said tilted edge, the lip is pushed away by the package blank passing the lip and then held in the erect position, supported against the perpendicularly upright edge of the lip, now springing back and protruding.

The bottom plate 2, tongue 4, and vertical support wall 3 of the tool can be prepared in one continuous piece, e.g. a steel plate, whereby the front edge of the bottom plate is made by a bending line between the bottom plate 2 and the support wall 3, and the tongue 4 is integrally formed by an opening 5 cut out in the support wall. The lip 8 and the spring means 9 are suitably arranged on the underside of an upper end area 12 of the support wall 3, bent backwards. In FIG. 2, a broken line illustrates the spring means 9 in the form of a torsion spring, pin spring or leaf spring 9, pre-stressing and thereby loading an arm mounted pivotably at P and formed with the lip 8 in the opposite end. In this connection it is to be noted that the tool shown may be arranged for simple switching between left hand position and right hand position, by alternative mounting positions P, P' for the lip 8 and the spring 9, and double slits for penetration of the lip 8 through the support wall 3 (as illustrated in FIG. 2).

Reference is now made to FIG. 5 and FIGS. 6*a*-6*d* for the use and function of the tool.

In a first operation for the completion of a box shaped package, the package blank is folded in accordance with FIG. 6*a* in the inner fold line B extending transversally over the width of the package blank. The protective zone thus folded in double is inserted against the abutment or support wall 3 into the gap between the jaw 6 and the tongue 4, whereafter the jaw is activated to hold the protective zone of the package blank by clamping against the tongue 4 in the direction of the arrow L in FIG. 6*a*. In this first support position, illustrated in FIG. 5 with the package blank shown in a broken single dot line, the package blank is held in order to facilitate the other operations during folding, such as the subsequent folds in the opposite end of the package blank.

In this connection it is to be pointed out that the jaw 6 preferably has a length protruding outside of the support wall and adapted to the distance between the fold lines B and C, and forming the height of the protective zone of doubled material. It is further proposed that the tongue 4 should comprise a mark, e.g. in the form of a slit 13 in the longitudinal direction of the tongue, towards which mark a fold line A can be oriented when the package blank is inserted into the tool for supporting contact against the abutment/support wall 3.

In the next operation, the end walls T, U of the package are erected by folding along fold lines C. The free-cut extensions X, V of the end walls are thereafter folded inwards in the direction of the respective fold lines A, forming the corners of the package, in the direction of the axial center of the package blank. After that folding, the extensions X, V of the end walls will extend supportively inside of and adjacent opposite lateral walls of the completed package. With this operation, the package blank has adopted the position shown in FIG. 6*b*.

Figure 5:
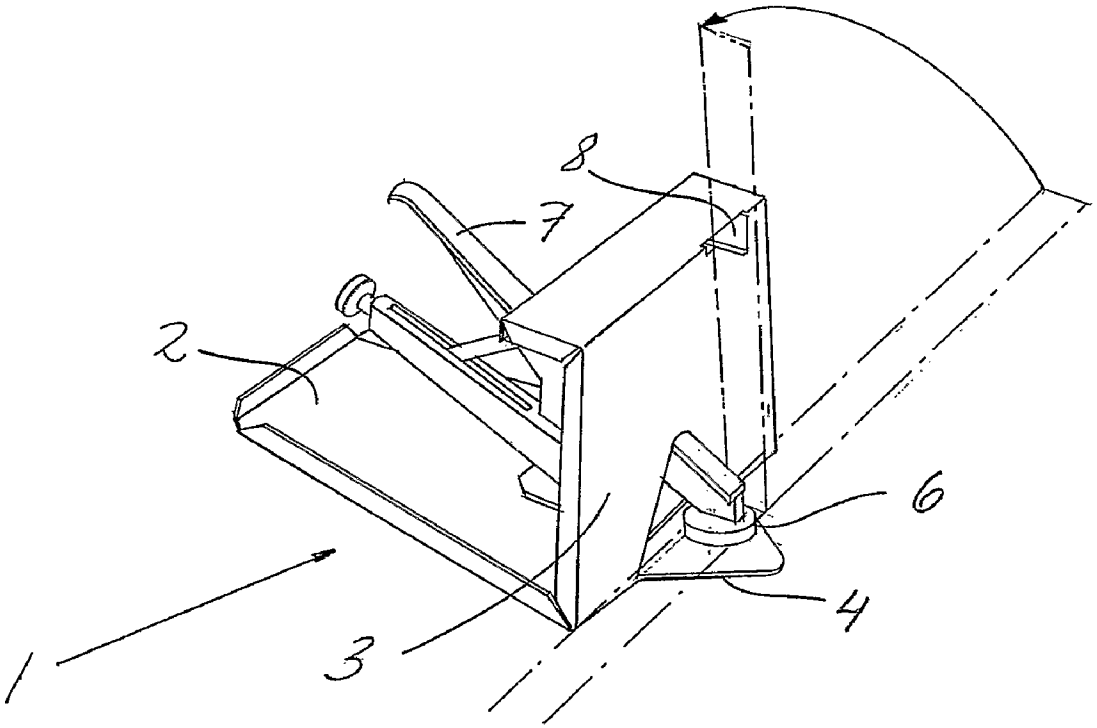
FIG. 5 shows the tool according to the invention in an oblique top/front perspective view.

Thereafter, a fold along a fold line A is performed to erect the lateral wall or walls positioned outside of the tool grip on the farthermost side of the tool, viewed from the position of the operator. This fold is performed so that the doubled rim, and more specifically that part thereof which forms an extension of the lateral wall connecting in said fold line A to the lateral wall held by the tool, during the erection operation passes the lip 8 and is thereby held in the upright position as shown in FIG. 6*c*. In FIG. 5, this second support position is illustrated with the package blank shown in a double dot broken line.

In this second support position, in which the tool aided by the lip 8 temporarily fixes the package blank in an open condition with the future "lid" in an upright position, products can easily be put into the package. The erect sections of the package blank, prevented by the lip 8 from falling back onto the work surface, in turn lock the in-folded extensions of the end walls T, U, whereby these, too, are locked in their erect positions. Thereby, the operator has both hands free for the insertion of products into a receiving space delimited on three sides by the end walls and the farthermost lateral wall, before the package blank is closed in order to form a package enclosing the products.

In a final folding operation along the remaining fold lines A, the erect upright wall, referred to as "lid" in the above paragraph, is lowered and the lateral wall closest to the operator is erected to close the package in accordance with FIG. 6*d*. The completely folded package may thereafter be detached from the tool by activating the release mechanism of the jaw.

The primary function of the tool is to form a "third hand" aiding the operator by temporarily fixing an attained folding position while both hands of the operator are busy performing the next folding operation of filling the package with products. Therefore, the tool is preferably utilized standing freely on a work table or on a conveyor belt in a production line in order enable the operator or operators in the line to handle the package blank freely for folding or insertion of products, but may alternatively be fixed on the work table, or integrated into this table by having the bottom plate fitted into the table surface or forming part of said surface. The shown embodiment of the tool is adapted for, and described as utilized in, the folding of a package blank designed to prepare a package having reinforced end zones, said package blank comprising parallel fold lines A along which the blank can be folded to form the lateral walls I of the package, fold lines B, C transversal to fold lines A along which the blank is foldable (B) to form a peripheral protective zone R of double folded material in the ends of the package, and foldable (C) to form the end walls T, U of the package with associated, free-cut extensions V, X, respectively. In this implementation, the tool thus comprises means 4, 6 which can be activated for engagement with the protective zone R for temporary clamping of the package blank against a work surface, as well as means 8 which can be activated in order to support a part of the package blank in a position erected from the work surface during the insertion of products into the package. The fact that the tool has been described in this implementation does not, obviously, exclude the utilization of the tool, where appropriate, with or without expertly constructive modifications, for the manual folding of other types of package blanks.

The invention claimed is:

1. A tool for manual folding of a package blank into a package, comprising:

a clamping means (4, 6) that can be activated for temporary clamping of the package blank against a work surface, and a support means (8) that can be activated for temporary supporting a part of the package blank in a position erected from the work surface during a folding operation, wherein, the support means (8) comprises a lip (8) which is spring loaded and back-springing and which is retractable against a force of a spring in result of said part of the package blank being made to pass by the lip as said part of the package blank is erected from the work surface during the folding operation, and which thereafter springs back to support said part of the package blank in the erected position, and the tool is configured as to form a third hand aiding an operator by temporarily fixing an attained folding position while both hands of the operator perform a next folding operation thereby assisting in a manual folding operation of the package blank.

2. The tool according to claim 1, further comprising a bottom plate (2) having an abutment (3) erect from a front edge of the bottom plate, into which the lip (8) is retractable against the force of a spring (9), further comprising a tongue (4) protruding from the front edge of the bottom plate and in front of the abutment, and a jaw (6) acting against the tongue from above.

3. The tool according to claim 2, wherein the jaw (6) is supported in a tip of a lockable leg (7) extending forward through an opening (5) in the abutment, above the tongue, above the tongue.

4. The tool according to claim 3, wherein the jaw (6) is provided with a release mechanism for single handed operation.

5. The tool according to claim 3, wherein the bottom plate (2) and the abutment (3) are formed integrally by bending a plate, and the tongue (4) is integrally formed by cutting an opening (5) in the abutment.

6. The tool according to claim 2, wherein the tongue (4) has a position mark in the form of a slit (13) extending in the longitudinal direction of the tongue.

7. The tool according to claim 2, wherein the bottom plate (2) is one of integrated in the work surface and forms a part of the work surface.

8. A tool for manual folding of a package blank into a package, comprising:

a bottom plate (2) with a front edge;

a support wall (3) located at the front edge of the bottom plate, the support wall extending substantially vertically erect;

a tongue (4) projecting from the front edge of the bottom plate, the tongue projecting in front of the support wall;

an opening (5) in the support wall;

a jaw (6) extending from the opening of the support wall and out above the tongue, a gap formed between the tongue and the jaw, the jaw movably for temporary clamping of a protective zone of a package blank in the gap between the tongue and the jaw;

a leg (7) mounted on the bottom plate and extending through the opening, the leg comprising a tip, the jaw supported on the tip of the leg, a lip (8) arranged in the support wall, the lip movable between a protruding position protruding in front of the support wall and a position retracted to one of i) inside of the support wall and ii) into the support wall;

a spring element (9) biasing the lip into the protruding position, the lip retractable against action of the spring element upon a part of the package blank during a fold operation being made to pass the lip, the lip being spring loaded and back-springing;

an edge (10) delimiting a protruding part of the lip, the edge, in a first part, being tilted in relation to the support wall and, and, in a second part in a tip of the lip, is substantially perpendicular to the support wall, wherein the lip is retractable against a force of the spring element in result of the part of the package blank being made to pass by the lip as said part of the package blank is erected from the work surface during the folding operation, and which thereafter springs back to support said part of the package blank in the erected position, the tool configured as a third hand aiding an operator by temporarily fixing an attained folding position while both hands of the operator are perform a next folding operation thereby assisting in a manual folding operation of the package blank.

9. The tool of claim 8, wherein, the bottom plate, tongue, and vertical support wall are one continuous plate, the front edge of the bottom plate is defined by a bending line between the bottom plate and the support wall, and the tongue is integrally formed by the opening in the support wall.

10. The tool of claim 9, wherein, the lip and the spring element (9) are arranged on an underside of an upper end area (12) of the support wall (3), the upper end area of the support wall being bent backwards with respect to the support wall.

11. The tool of claim 10, wherein, the spring element comprises one of a torsion spring, a pin spring, a leaf spring, the lip comprises a pivotable arm, the spring element pre-stresses and thereby loads the pivotable arm.

12. A tool for manual folding of a package blank into a package, comprising:

a bottom plate (2) with a front edge;

a support wall (3) extending substantially vertically erect from the front edge;

a tongue (4) projecting, from the front edge of the bottom plate, in front of the support wall;

an opening (5) in the support wall;

a leg (7) mounted on the bottom plate and extending through the opening, the leg comprising a tip;

a jaw (6) supported at the tip of the leg, the extending from the opening above the tongue with a gap formed between the tongue and the jaw, the jaw movably for temporary clamping of a protective zone of a package blank in the gap between the tongue and the jaw;

a lip (8) arranged at an upper portion of the support wall, the lip movable between a protruding position protruding in front of the support wall and a position retracted to one of i) inside of the support wall and ii) into the support wall;

a spring element (9) biasing the lip into the protruding position, the lip retractable against action of the spring element upon a part of the package blank during a fold operation being made to pass the lip, the lip being spring loaded and back-springing;

an edge (10) delimiting a protruding part of the lip, the edge, in a first part, being tilted in relation to the support wall, wherein the lip is retractable against a force of the spring element in result of the part of the package blank being made to pass by the lip as said part of the package blank is erected from the work surface during the folding operation, and which thereafter springs back to support said part of the package blank in the erected position, the tool configured as a third hand aiding an operator by temporarily fixing an attained folding position while both hands of the operator are perform a next folding operation thereby assisting in a manual folding operation of the package blank.

13. The tool of claim 12, wherein, the bottom plate, tongue, and vertical support wall are one continuous plate, the front edge of the bottom plate is defined by a bending line between the bottom plate and the support wall, and the tongue is integrally formed by the opening in the support wall.

14. The tool of claim 13, wherein, the lip and the spring element (9) are arranged on an underside of an upper end area (12) of the support wall (3), the upper end area of the support wall being bent backwards with respect to the support wall.

15. The tool of claim 14, wherein, the spring element comprises one of a spring, the lip comprises a pivotable arm, the spring pre-stresses and thereby loads the pivotable arm.

* * * * *